US011667140B2

(12) United States Patent
Tokuda et al.

(10) Patent No.: US 11,667,140 B2
(45) Date of Patent: Jun. 6, 2023

(54) PRINTING SYSTEM, READING APPARATUS, AND HOLDING APPARATUS FOR READING APPARATUS

(71) Applicant: CANON KABUSHIKI KAISHA, Tokyo (JP)

(72) Inventors: Kouhei Tokuda, Fuchu (JP); Hideyuki Nozawa, Utsunomiya (JP)

(73) Assignee: Canon Kabushiki Kaisha, Tokyo (JP)

( * ) Notice: Subject to any disclaimer, the term of this patent is extended or adjusted under 35 U.S.C. 154(b) by 54 days.

(21) Appl. No.: 16/820,352

(22) Filed: Mar. 16, 2020

(65) Prior Publication Data

US 2020/0307288 A1 Oct. 1, 2020

(30) Foreign Application Priority Data

Mar. 29, 2019 (JP) ..... JP2019-068042

(51) Int. Cl.
*B41J 29/02* (2006.01)
*B41J 29/13* (2006.01)

(52) U.S. Cl.
CPC ..... *B41J 29/02* (2013.01); *B41J 29/13* (2013.01)

(58) Field of Classification Search
CPC ..... B41J 29/02; B41J 29/13
See application file for complete search history.

(56) References Cited

U.S. PATENT DOCUMENTS 4,040,615 A * 8/1977 Kurosaki ..... G03B 27/6264 414/737
8,120,821 B2 * 2/2012 Ishida ..... H04N 1/00551 358/474
2005/0151782 A1 * 7/2005 Ishida ..... B41J 29/02 347/37
2016/0009100 A1 * 1/2016 Kudo ..... B41J 2/175 347/92
2016/0044192 A1 * 2/2016 Jo ..... G03G 15/605 358/1.13
2016/0202734 A1 * 7/2016 Smith ..... G06F 1/1667 361/679.2

(Continued)

FOREIGN PATENT DOCUMENTS

JP 2000006727 A * 1/2000
JP 2001097422 A * 4/2001
JP 2016-005895 A 1/2016

*Primary Examiner* — David H Banh
(74) *Attorney, Agent, or Firm* — Canon U.S.A., Inc. I.P. Division

(57) ABSTRACT

A technique advantageous to stably holding a reading apparatus relative to a printing apparatus is provided. A printing system includes a recording apparatus and a reading apparatus. The recording apparatus includes a housing that incorporates a printing unit that performs printing on a recording medium. The housing includes a front surface portion having a discharge port for discharging the recording medium on which printing is performed, a back surface portion facing the front surface portion, and a side surface portion connecting the front surface portion with the back surface portion. The printing system includes a holding unit connected to the housing at least at one end, and holding the reading apparatus above the housing. The holding unit includes a first fixing member for fixing to the back surface portion, and a second fixing member for fixing to the side surface portion.

24 Claims, 15 Drawing Sheets

(56) References Cited

U.S. PATENT DOCUMENTS

| | | | | |
|---|---|---|---|---|
| 2017/0180573 | A1* | 6/2017 | Kuroki | H04N 1/00559 |
| 2017/0190193 | A1* | 7/2017 | Migita | H04N 1/00554 |
| 2017/0266968 | A1* | 9/2017 | Ishibe | B41J 2/17509 |

* cited by examiner

PRINTING SYSTEM, READING APPARATUS, AND HOLDING APPARATUS FOR READING APPARATUS

BACKGROUND OF THE DISCLOSURE

Field of the Disclosure

The present disclosure relates to a printing system including a recording apparatus and a reading apparatus, and to a reading apparatus and a holding apparatus for a reading apparatus.

Description of the Related Art

A single-function printing apparatus specialized for printing on a sheet of large-format size and a multi-function peripheral having a plurality of processing functions are currently known. Japanese Patent Application Laid-Open No. 2016-005895 discusses a recording system that independently holds a reading apparatus for reading an original document separate from a printing apparatus on a movable stand, and disposes the reading apparatus next to the printing apparatus. This printing system enables a user to selectively use the printing apparatus and the reading apparatus.

Meanwhile, as discussed in Japanese Patent Application Laid-Open No. 2016-005895, there is a problem that an installation area for the entire printing system is increased, in a case where the printing apparatus and the reading apparatus are disposed next to each other by using the separated movable stand. Therefore, it is desirable to provide a configuration for directly or indirectly fixing the reading apparatus and holding the fixed reading apparatus with respect to the printing apparatus, in order to decrease the installation area. However, in Japanese Patent Application Laid-Open No. 2016-005895, no study is made on a holding mechanism for fixing the reading apparatus and holding the fixed reading apparatus relative to the printing apparatus. Therefore, there is a possibility that the reading apparatus cannot be stably held with respect to the printing apparatus, depending on the holding mechanism.

SUMMARY OF THE DISCLOSURE

The present disclosure is directed to a technique advantageous to holding of a reading apparatus with respect to a printing apparatus.

According to an aspect of the present disclosure, a printing system includes a recording apparatus and a reading apparatus, the recording apparatus including a housing that incorporates a printing unit that performs printing on a recording medium, the housing including a front surface portion having a discharge port for discharging the recording medium on which printing is performed, a back surface portion facing the front surface portion, and a side surface portion connecting the front surface portion with the back surface portion, and the printing system includes a holding unit connected to the housing at least at one end, and holding the reading apparatus above the housing, wherein the holding unit includes a first fixing member for fixing to the back surface portion, and a second fixing member for fixing to the side surface portion.

Further features and aspects of the present disclosure will become apparent from the following description of example embodiments with reference to the attached drawings.

DESCRIPTION OF THE EMBODIMENTS

Figure 1:
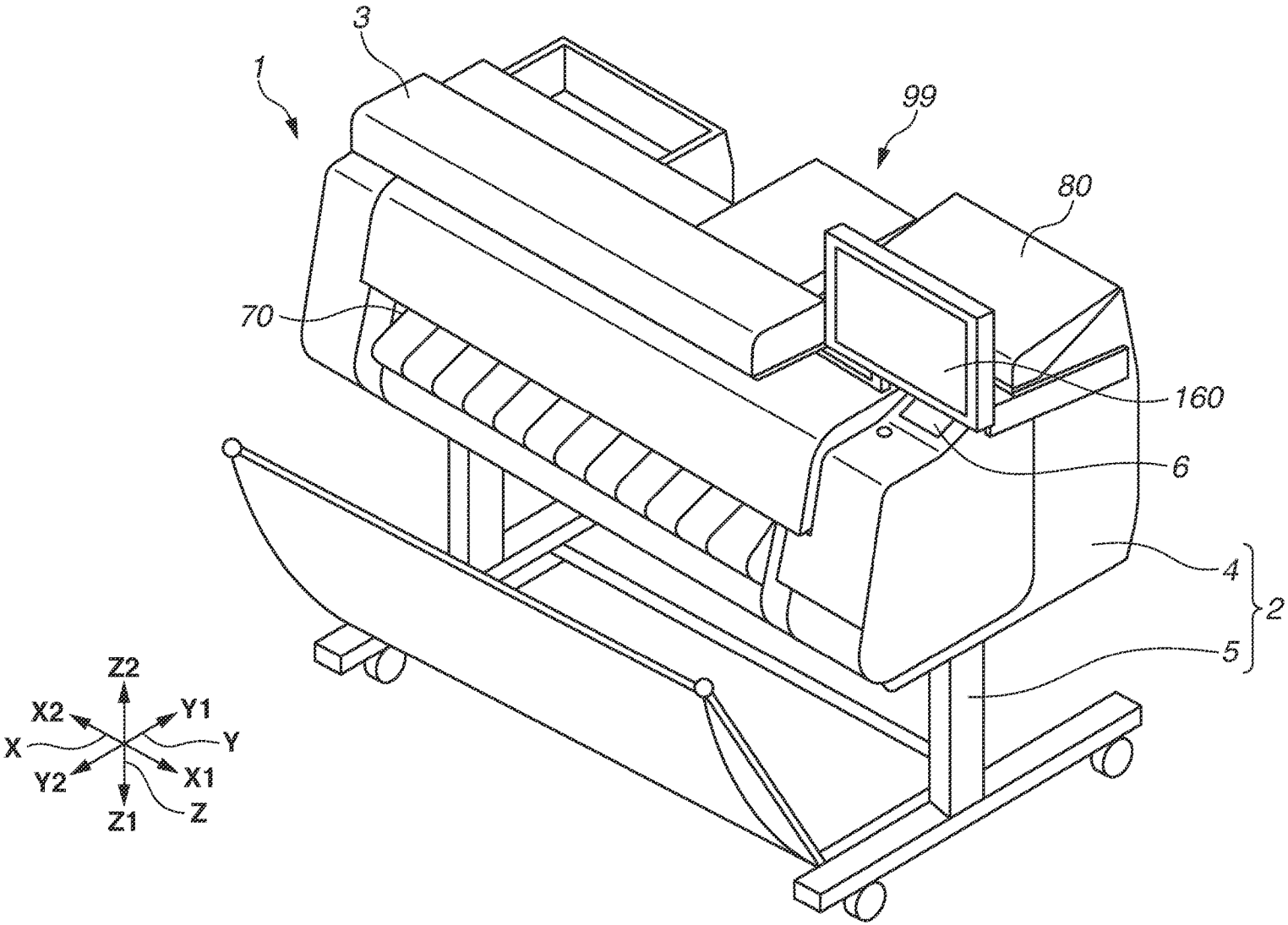
FIG. 1 is a perspective diagram illustrating a printing system according to a first example embodiment.

Numerous example embodiments and features of the present disclosure will be described below with reference to the drawings. In each of the drawings, same or corresponding parts are provided with the same reference numerals. Further, in the drawings, an X-direction and a Y-direction indicate two axial directions orthogonal to each other on a horizontal plane, and a Z-direction indicates a vertical direction. Furthermore, a Y1-direction and a Y2-direction are directions parallel to a Y-axial direction (the Y-direction). The Y1-direction indicates a conveyance direction of an original document in a reading apparatus 3 to be described below, and the Y2-direction indicates a direction opposite to the Y1-direction. A Z1-direction indicates a downward direction of the vertical direction, and a Z2-direction indicates an upward direction of the vertical direction.

Explanation of Terms

In the description, "recording" (may also be referred to as "printing") refers to cases where information is formed, irrespective of whether the information is meaningful (e.g., information such as text and graphics) or meaningless. The "recording" also represents all kinds of cases including a case where an object such as an image, a design, or a pattern is formed on a recording medium, and a case where a medium is processed, irrespective of whether the object is visualized so that a human being can visually recognize the object.

Further, "recording medium" represents not only paper to be used in a general recording apparatus, but also a wide range of materials that can receive ink, including cloth, plastic films, metal plates, glass, ceramic, wood, and leather. In the following example embodiments, a case where the recording medium is a roll sheet (or merely referred to as "sheet" in some cases) will be described, but the example embodiments are not limited to this case.

First Example Embodiment

FIG. 1 is a perspective diagram illustrating a printing system according to a first example embodiment. In FIG. 1, a printing system 1 includes a recording apparatus 2, the reading apparatus 3, and a holding unit 99.

The recording apparatus 2 has a function of printing on a sheet. The recording apparatus 2 includes a body unit 4 that holds each mechanism, and a leg unit 5 that holds the body unit 4 in a predetermined position in the Z direction. The body unit 4 holds each mechanism in the inside of a housing unit 41 (see FIG. 2) having a substantially cuboid shape. The exterior of the housing unit 41 has an operation panel 6, a discharge port 70, and an ink tank cover 80. The operation panel 6 has functions of, for example, performing various kinds of setting operations, inputting commands, and checking information about the recording apparatus 2. The discharge port 70 includes an opening for discharging a sheet on which an image is printed, and a portion around the opening. In each of the example embodiments, a surface having the discharge port 70 in the housing unit 41 is referred to as "the front surface of the housing unit 41", and a surface facing the front surface is referred to (as "the back surface of the housing unit 41". Further, surfaces that connect the front surface and the back surface of the housing unit 41 when viewed from the discharge port 70 are the top surface, are referred to as the under surface, and side surfaces (or the right side surface and the left side surface) of the housing unit 41, respectively. In a state where the ink tank cover 80 is open, an ink tank is accessible, so that a user can replace the ink tank. In FIG. 1, the ink tank cover 80 is in a closed state. A specific configuration of the recording apparatus 2 will be described in detail with reference to FIG. 2.

The reading apparatus (a document scanning apparatus) 3 has a function of reading, for example, an image on an original document. A specific configuration of the reading apparatus 3 will be described in detail with reference to FIG. 3.

The holding unit 99 is connected to the housing unit 41 at least at one end, and has a function of holding the reading apparatus 3 at a position above the recording apparatus 2. The holding unit 99 includes a first fixing member 100 for fixing the discharge port 70 to the back surface of the housing unit 41 when viewed from the Y1-direction, and a second fixing member 180 for fixing the discharge port 70 to the side surface of the housing unit 41 when viewed from the Y1-direction. The second fixing member 180 includes a relay member 130 and a side surface fixing member 140. A specific configuration will be described in detail with reference to FIG. 5. In other words, the holding unit 99 functions singly as a holding apparatus that holds the reading apparatus 3.

A display operating unit 160 includes an operation portion such as a button for inputting an input instruction for operation such as reading operation to the reading apparatus 3, and a display portion for displaying information such as a state of the reading apparatus 3 and an image. The display operating unit 160 may have only one function of either the display portion or the operation portion.

Figure 2:
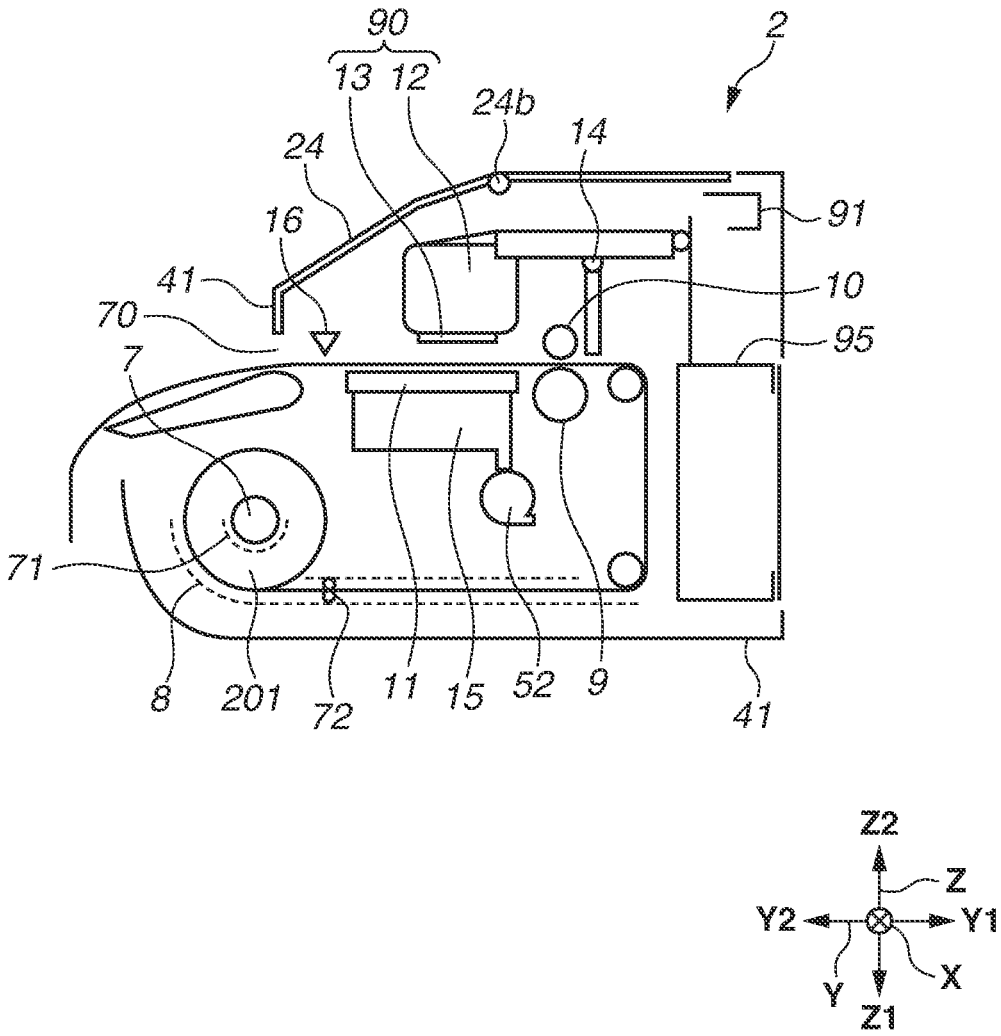
FIG. 2 is a cross-sectional diagram illustrating an example recording apparatus.

Next, a schematic configuration of the recording apparatus 2 will be described with reference to FIG. 2. FIG. 2 is a cross-sectional diagram illustrating the recording apparatus 2 in the present example embodiment. The recording apparatus 2 can print an image on a sheet supplied from a roll sheet 201. Operation for printing an image on a sheet will be described below, together with an internal configuration of the recording apparatus 2.

In a case where an image is to be printed on the roll sheet 201, the user first inserts a roll holder 7 into a central hole of the roll sheet 201, so that the roll holder 7 is rotatably held by a roll holding unit 71 provided in the recording apparatus 2. After setting the roll holder 7 in the state of being held by the roll holding unit 71, the user sends the sheet drawn from the roll sheet 201 toward the downstream side along a lower guide 8. Here, when the leading edge of the roll sheet 201 arrives at a roller pair 72, the roller pair 72 is rotated by a motor (not illustrated). The sheet is thereby conveyed in a sheet feeding path, and when the sheet arrives at a nip portion between a conveyance roller 9 and a driven roller 10, a conveyance motor 51 (illustrated in FIG. 4) rotates the conveyance roller 9. The sheet is thereby held pinched between the conveyance roller 9 and the driven roller 10. Afterward, the sheet is conveyed to a platen 11 by the rotation of the conveyance roller 9.

The platen 11 holds the sheet in a flat state from the back surface of the sheet, and maintains a clearance suitable for printing between a recording head 13 and the sheet. A plurality of suction holes for sucking the sheet is formed in the platen 11, in order to prevent phenomena such as floating and distortion of the sheet on the platen 11. The suction holes communicate with a suction fan 52 via a duct 15. Driving the suction fan 52 causes a negative pressure in the suction holes of the platen 11, so that the sheet passing on the platen 11 moves on the platen 11 while being sucked by the suction holes.

A printing unit 90 includes a carriage 12 and the recording head 13, and makes prints on the recording medium. The carriage 12 reciprocates along a carriage shaft 14 in the X-direction (a main scanning direction). The recording head 13 is mounted on the carriage 12. In the recording head 13, a plurality of arrays of ejection ports for discharging ink is arranged along a direction intersecting the X-direction (i.e., a direction (the Y-direction) orthogonal to the X-direction, in the present example embodiment). The recording head 13 in the present example embodiment constitutes a serial-type printer that makes prints on a sheet while moving in the X-direction, but is not limited thereto. For example, the recording head 13 may be a line scan head.

While moving in the X-direction together with the carriage 12, the recording head 13 ejects the ink from the ejection ports based on recording data. As a result, an image (an image for one band) having a width corresponding to the number of the arrays of the ejection ports is printed on the sheet. After the image for one band is printed, the sheet is conveyed by the rotation of the conveyance roller 9 in the Y-direction at a predetermined distance. Afterward, again, the carriage 12 moves and the recording head 13 ejects the ink, so that an image for the next band is printed. The operation for recording on the sheet and the operation for conveying the sheet are repeated, so that a predetermined image (e.g., an image for one page) is printed on the sheet.

The sheet on which printing is performed by the recording head 13 is discharged from the discharge port 70. The discharge port 70 is provided downstream from the recording head 13 in the conveyance direction (the Y-direction). It is desirable that the discharge port 70 be at a position which the user can easily access, and the discharge port 70 is provided in the front surface of the housing unit 41.

The ink is stored in the ink tank, and is supplied to the recording head 13 by using a tube. When the ink tank cover 80 is opened, the ink tank (an ink tank 81 illustrated in FIGS. 11A and 11B) becomes accessible, so that the user can replace the ink tank.

Inside the recording apparatus 2, a cutter 16 is disposed downstream from the recording head 13 in the conveyance direction (the Y-direction), so that the sheet drawn from the roll sheet 201 can be cut and given a predetermined length.

An upper cover 24 for covering an upper portion of the recording head 13 is provided at an upper part of the front surface side of the housing unit 41 of the recording apparatus 2, and the upper cover 24 can turn around a turning center 24*b*. Therefore, the upper cover 24 can rotate to move between a closed position for covering the upper portion of the recording head 13 as illustrated in FIG. 2, and an open position for exposing the recording head 13 on the outside.

Further, the back surface of the housing unit 41 of the recording apparatus 2 is provided with a substrate holding member 95 for storing a power source and a control circuit for controlling each mechanism. The substrate holding member 95 is a member having a substantially cuboid shape extending in the X-direction of the recording apparatus 2, and made of a metal sheet having a substantially square shape in cross section to form a space in the inside thereof. The substrate holding member 95 has high rigidity as compared with other members of the recording apparatus. Therefore, the substrate holding member 95 is suitable for fixing the holding unit 99. Further, a fixing metal sheet 91 for mounting an exterior component that forms an outer wall of the body unit 4 is disposed at a rear part of the top surface of the recording apparatus 2. The fixing metal sheet 91 has a U-shape in cross section and is a member having a substantially cuboid shape extending in the X-direction of the recording apparatus 2. The fixing metal sheet 91 has high rigidity as compared with other members of the recording apparatus 2. Therefore, the fixing metal sheet 91 is suitable for fixing the holding unit 99.

Figure 3:
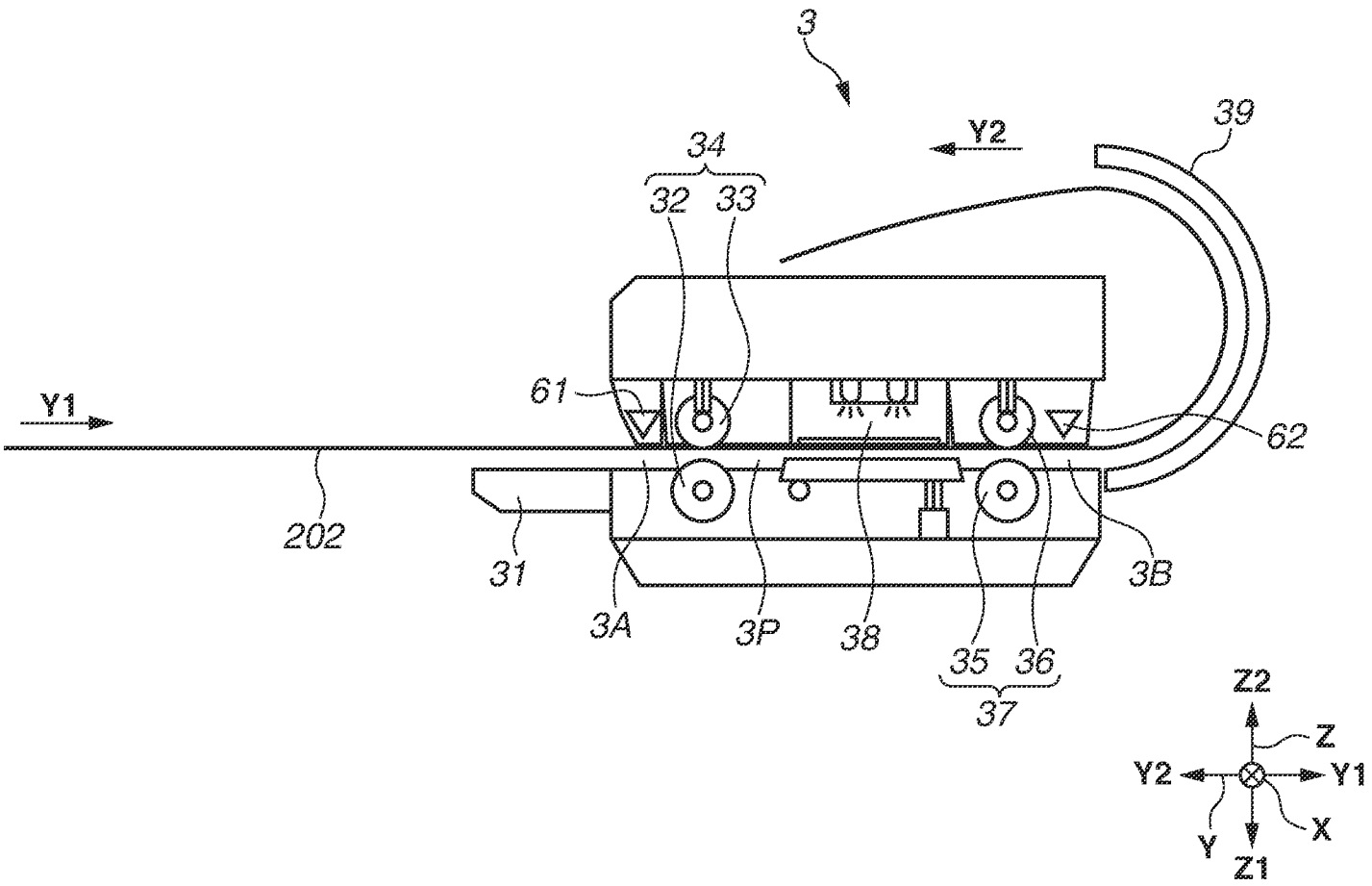
FIG. 3 is a cross-sectional diagram illustrating an example reading apparatus.

Next, a schematic configuration of the reading apparatus 3 in the present example embodiment will be described with reference to FIG. 3. FIG. 3 is a cross-sectional diagram illustrating the reading apparatus 3 in FIG. 1. In FIG. 3, the reading apparatus 3 reads an image by using a reading unit 38 while conveying an original document 202. The reading apparatus 3 has a conveyance path 3P that runs from an insertion slot 3A for inserting an original document to a discharge port 3B for discharging the original document. The original document inserted into the insertion slot 3A is conveyed along the conveyance path 3P. The reading apparatus 3 has a document placement portion 31 shaped like a plate and protruding frontward (leftward in FIG. 3) from a lower edge part of the insertion slot 3A. The document placement portion 31 has a width (a length in the X-direction) substantially the same as the insertion slot 3A, holds the original document from below, specifically, a non-reading surface opposite to a reading surface of the original document, and guides the original document for the insertion into the insertion slot 3A. Further, a document discharging portion 39 is disposed on the back surface side (on the right side in FIG. 3) of the reading apparatus 3. The document discharging portion 39 has a curved shape and guides the original document discharged from the discharge port 3B, to the top surface of the reading apparatus 3. In the conveyance path 3P, an upstream side conveyance unit 34 is disposed on the upstream side, and a downstream side conveyance unit 37 is disposed on the downstream side. The original document is conveyed by the upstream side conveyance unit 34 and the downstream side conveyance unit 37 along the conveyance path 3P. The upstream side conveyance unit 34 includes an upstream side conveyance roller 32 and an upstream side driven roller 33 facing the upstream side conveyance roller 32. The downstream side conveyance unit 37 includes a downstream side conveyance roller 35 and a downstream side driven roller 36 facing the downstream side conveyance roller 35.

The reading unit 38 that reads the original document is disposed between the upstream side conveyance unit 34 and the downstream side conveyance unit 37. The reading unit 38 is configured of a contact image sensor (CIS) having an array of light receiving elements in width corresponding to a large-format original document to be used. Another type of sensor such as a linear sensor using a charge coupled device (CCD) may also be used.

In a case where the original document 202 is to be read by using the reading apparatus 3, the user places a front part of the original document 202 on the document placement portion 31, and inserts the original document 202 into the insertion slot 3A along a guide surface of the document placement portion 31. When the leading edge of the original document 202 is inserted into the conveyance path 3P from the insertion slot 3A, an upstream document sensor 61 disposed near the insertion slot 3A detects the original document 202, i.e., the upstream document sensor 61 detects the insertion of the original document 202 into the insertion slot 3A. When the leading edge of the original document 202 arrives at a nip portion formed by the upstream side conveyance roller 32 and the upstream side driven roller 33 of the upstream side conveyance unit 34, the upstream side conveyance roller 32 is rotated in the normal direction by an original document conveyance motor 53 illustrated in FIG. 4. The original document 202 thereby enters an area between the upstream side conveyance roller 32 and the upstream side driven roller 33 and then held therebetween.

In the present example embodiment, there is a delay time between the detection of the leading edge of the document 202 by the upstream document sensor 61 and the rotation of the upstream side conveyance roller 32. This delay time corresponds to a standby time before the entire area of the leading edge of the original document 202 in the width direction abuts the nip portion of the upstream side conveyance unit 34. The upstream side conveyance roller 32 rotates in a state where the entire leading edge of the original document 202 abuts the nip portion, so that conveyance in a state where the leading edge of the original document 202 is placed askew relative to the upstream side conveyance roller 32 can be prevented. About 0.5 to 2 seconds are suitable for the delay time. However, the optimum value of the delay time varies depending on the distance between the upstream document sensor 61 and the upstream side conveyance unit 34.

The upstream side conveyance roller 32 is driven to rotate, so that the original document 202 is conveyed to the reading unit 38. After that, the original document 202 is held between the downstream side conveyance roller 35 rotated by the original document conveyance motor 53 in the normal direction as with the upstream side conveyance roller 32 and the downstream side driven roller 36, and conveyed until a downstream document sensor 62 detects the original document 202. In the meantime, the reading unit 38 executes operation for reading the original document 202 which passes a reading area of the reading unit 38, as pre-detecting operation. Information about the width and a skew of the original document 202 is acquired by the reading operation. Upon completion of the pre-detecting operation, the upstream side conveyance roller 32 and the downstream side conveyance roller 35 are rotated in the reverse directions by the original document conveyance motor 53, so that the original document 202 is returned to the upstream side to be in a standby state. In the operation for returning the original document 202, the leading edge position of the original document 202 in the standby state is controlled to be located downstream from the nip portion of the upstream side conveyance unit 34 and upstream from the reading area of the reading unit 38, in the conveyance direction (the Y1-direction).

When a reading-operation start command is input via a unit such as the display operating unit 160 after the pre-detecting operation is completed, the upstream side conveyance unit 34 and the downstream side conveyance unit 37 convey the original document 202 in the document conveyance direction (the Y1-direction), while the reading unit 38 executes the document reading operation. When the upstream document sensor 61 detects the trailing edge of the original document 202, the trailing edge of the original document 202 is conveyed to a position located downstream from the reading area for the reading unit 38 and upstream from a nip portion of the downstream side conveyance unit 37, in the conveyance direction (the Y1-direction). The document reading operation ends remaining in this state. After that, when a discharge-operation start command is input from a unit such as the display operating unit 160, the downstream side conveyance unit 37 conveys the original document 202 again, so that the original document 202 is released from holding by the downstream side conveyance unit 37. The original document 202 can be thus extracted. Upon passing through the document discharging portion 39, the original document 202 is conveyed in a reverse direction (the Y2-direction) opposite to the conveyance direction (the Y1-direction), and discharged to the top surface side of the reading apparatus 3. Therefore, the user can carry out both of an operation for inserting the original document 202 into the insertion slot 3A and an operation for extracting the read original document 202, from the same direction (the front surface side), so that operability is favorably achieved. In the present example embodiment, the operation for conveying the original document 202 is temporarily stopped in the state where the original document 202 is nipped by the downstream side conveyance unit 37, after the document reading operation is completed. However, the operation for conveying the original document 202 after the document reading operation is completed may be continued until the original document 202 is released from nipping by the downstream side conveyance unit 37, without being stopped.

Figure 4:
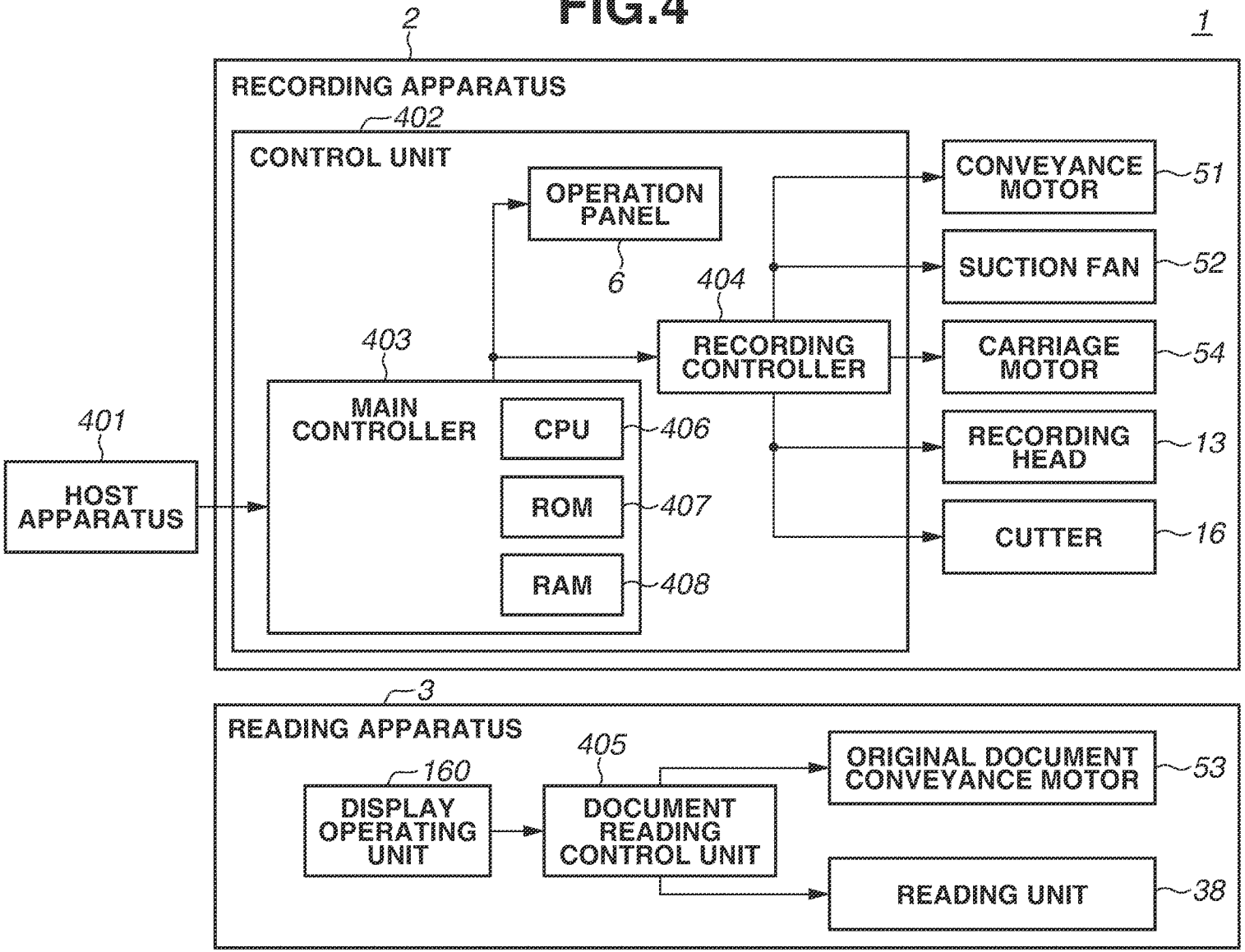
FIG. 4 is a block diagram illustrating an example hardware configuration of the printing system.

Next, a schematic configuration of a control system according to the present example embodiment will be described with reference to FIG. 4. FIG. 4 is a block diagram illustrating a hardware configuration of the printing system 1. A host apparatus 401 is connected to the printing system 1, and recording data and various control commands generated in the host apparatus 401 are transmitted to a control unit 402. The control unit 402 mainly includes a main controller 403 and a recording controller 404. The main controller 403 includes a central processing unit (CPU) 406, a read only memory (ROM) 407, and a random access memory (RAM) 408. The CPU 406 controls the entire printing system 1, by performing various calculations based on various programs and parameters stored in the ROM 407, while using the RAM 408 as a work area. The recording controller 404 controls components such as the conveyance motor 51, the suction fan 52, a carriage motor 54, the recording head 13, and the cutter 16, based on instructions of the main controller 403.

A document reading control unit 405 controls components such as the original document conveyance motor 53 and the reading unit 38, based on inputs to the display operating unit 160.

Figure 5:
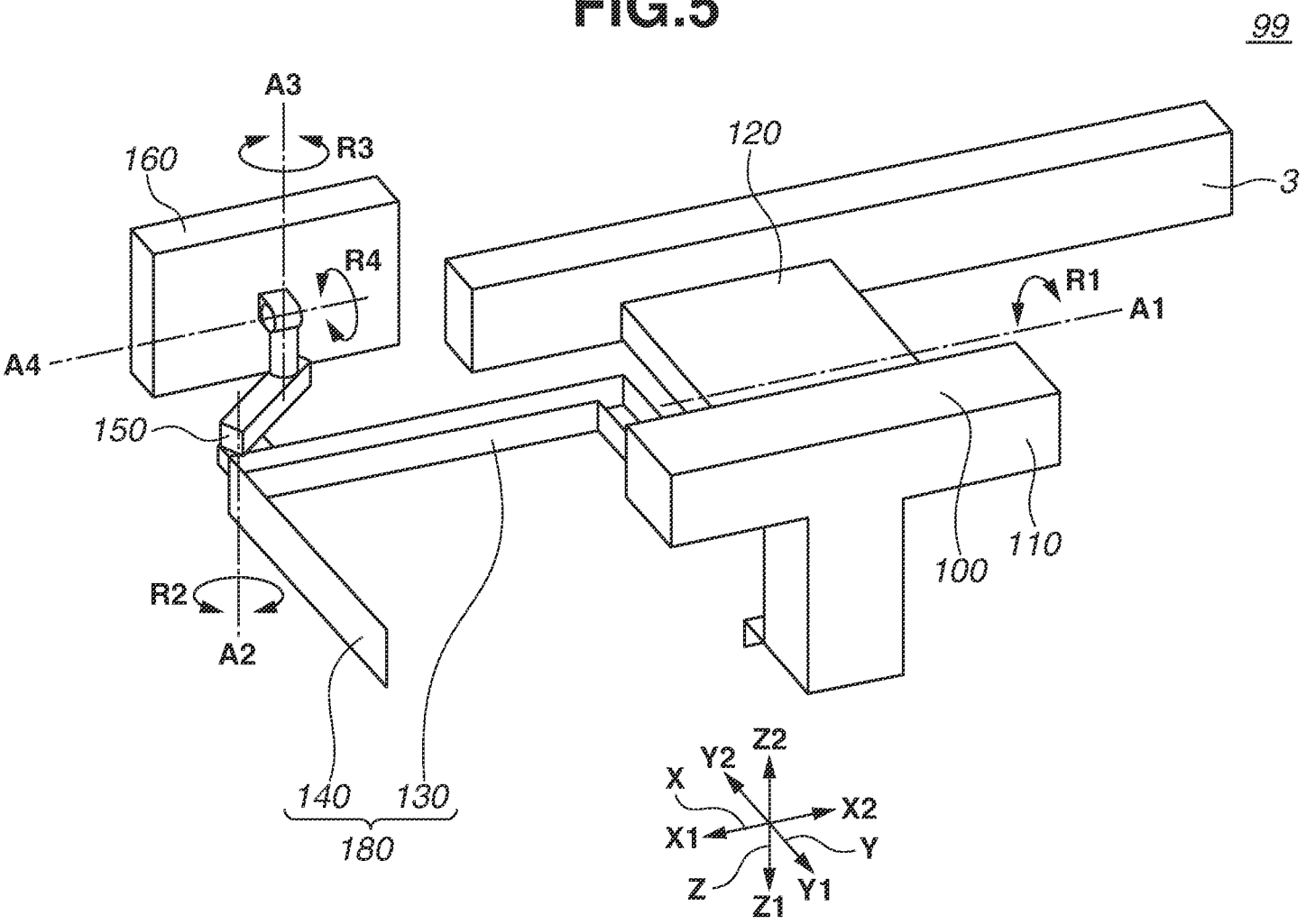
FIG. 5 is a perspective diagram illustrating an example holding unit.

Next, the holding unit 99 that holds the reading apparatus 3 relative to the recording apparatus 2 will be described with reference to FIG. 5. FIG. 5 is a perspective diagram illustrating the reading apparatus 3, the display operating unit 160, and the holding unit 99 as viewed from the rear. In FIG. 5, the recording apparatus 2 is omitted for simplification. The holding unit 99 includes at least the first fixing member 100 and the second fixing member 180. The second fixing member 180 includes at least the relay member 130 and the side surface fixing member 140. The holding unit 99 further includes a base cover 110, a turning arm 120, and a monitor holding portion 150.

In a case where the holding unit 99 is viewed from the back surface, the first fixing member 100 is substantially T-shaped. The first fixing member 100 includes a base upper portion 111 (illustrated in FIGS. 6A and 6B) that extends in the X-direction and is fixed to the body unit 4, and a base lower portion 112 (illustrated in FIGS. 6A and 6B) that extends in the Y-direction and is fixed to the leg unit 5. The first fixing member 100 holds the reading apparatus 3 through the turning arm 120. In other words, the first fixing member 100 is fixed at least at one end to the back surface of the housing unit 41 of the recording apparatus 2, and also has a function of holding the reading apparatus 3. How the first fixing member 100 is connected to the recording apparatus 2 and the turning arm 120 will be described in detail with reference to FIGS. 6A and 6B. The base cover 110 has a function of covering the back surface of the first fixing member 100.

The turning arm 120 has a rotation axis A1, and has a function of rotatably holding the reading apparatus 3 in an R1-direction. The turning arm 120 holds the reading apparatus 3 at the front end. In other words, in a state where the reading apparatus 3 is fixed to the turning arm 120, the user can hold the reading apparatus 3 in a plurality of positions defined by the axis A1, by operating the turning arm 120.

The relay member 130 is connected to the first fixing member 100 at one end, and connected to the side surface fixing member 140 at the other end. The side surface fixing member 140 is fixed to the side surface of the housing unit 41 of the recording apparatus 2. Further, the relay member 130 has a function of holding the monitor holding portion 150 and the display operating unit 160.

The monitor holding portion 150 has a rotation axis A2, and has a function of holding rotatably the relay member 130 in an R2-direction to. The display operating unit 160 is attached to the monitor holding portion 150. The display operating unit 160 has a rotation axis A3 and a rotation axis A4, and is held rotatably in an R3-direction and an R4-direction, relative to the monitor holding portion 150. The relay member 130 and the side surface fixing member 140 in the second fixing member 180 are separate members, but are not limited to this configuration and may be integrated into one member.

Figure 6B:
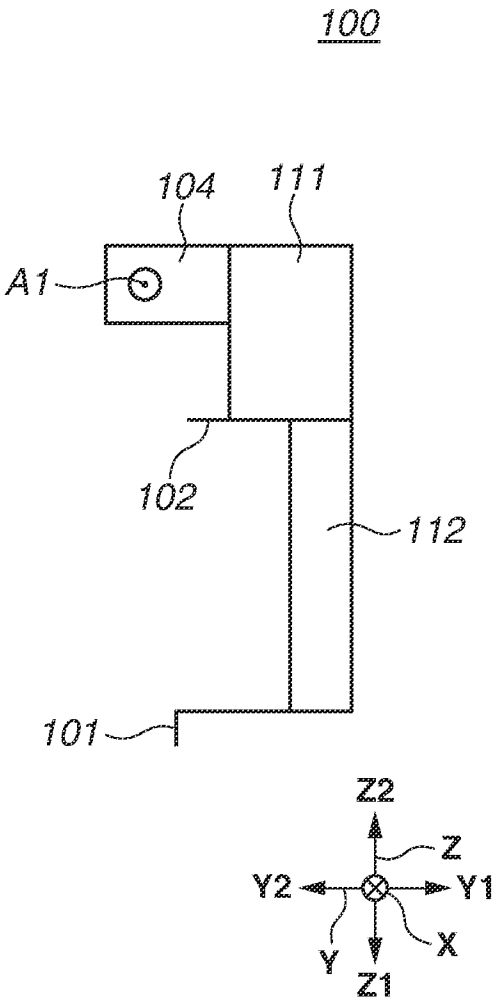
FIG. 6B is a diagram illustrating a side view of the first fixing member.
Figure 6A:
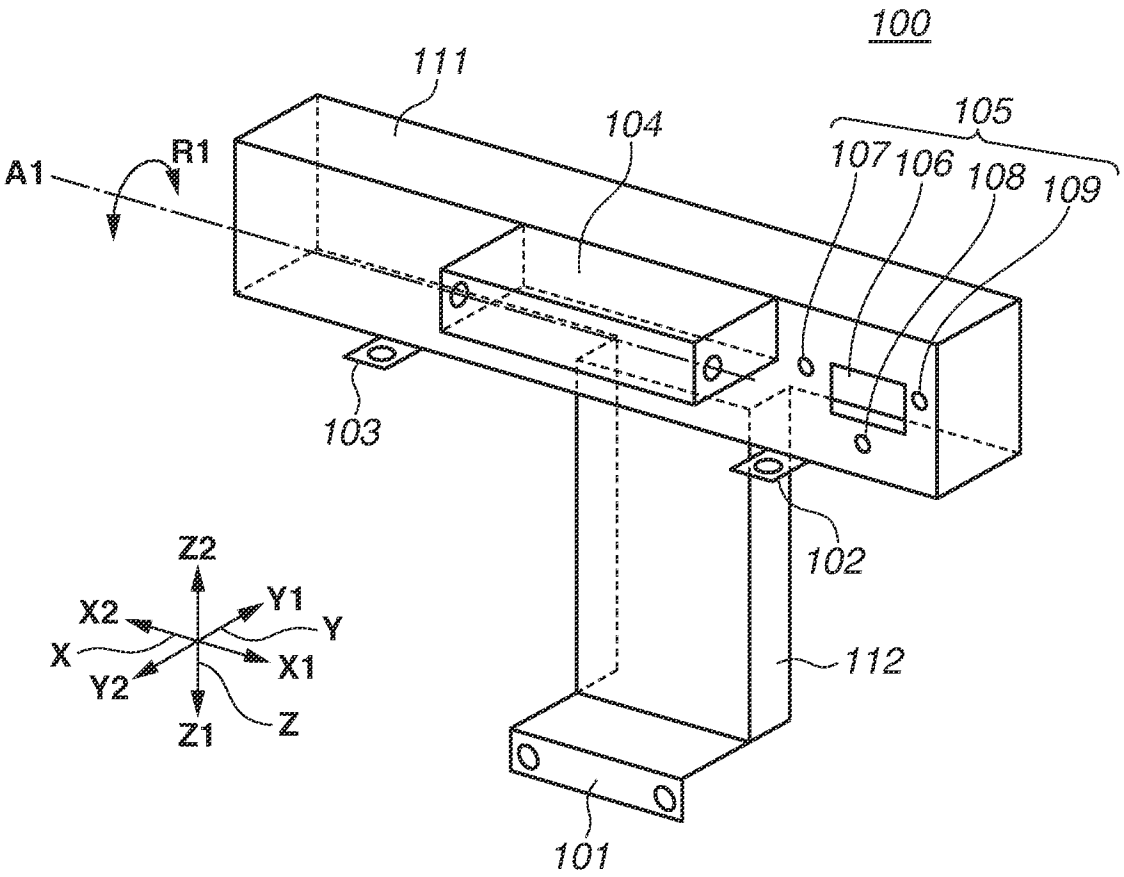
FIG. 6A is a perspective diagram illustrating an example first fixing member.

FIGS. 6A and 6B are a perspective diagram and a cross-sectional diagram, respectively, illustrating the first fixing member 100. FIG. 6A is a perspective diagram illustrating the first fixing member 100 as viewed from the discharge port 70 side (the front surface side of the housing unit 41) of the recording apparatus 2. FIG. 6B is a diagram illustrating a side view of the first fixing member 100 when the first fixing member 100 is perpendicularly viewed in the X-direction.

The first fixing member 100 includes connection portions 101 and 102 having openings for fixing to the housing unit 41 of the recording apparatus 2. The first fixing member 100 further includes a connection portion 103 having an opening for fixing to the recording apparatus 2. The first fixing member 100 further includes a connection portion 104 for connection to the turning arm 120, and a connection portion 105 for connection to the relay member 1300.

The first fixing member 100 is substantially T-shaped, and includes the base upper portion 111 having a substantially cuboid shape and extending in the X-direction, and the base lower portion 112 having a substantially cuboid shape and extending in the Y-direction. The connection portion 104 has a substantially cuboid shape having a long side in the X-direction, and is disposed next to the base upper portion 111 in the Y-direction.

Figure 7:
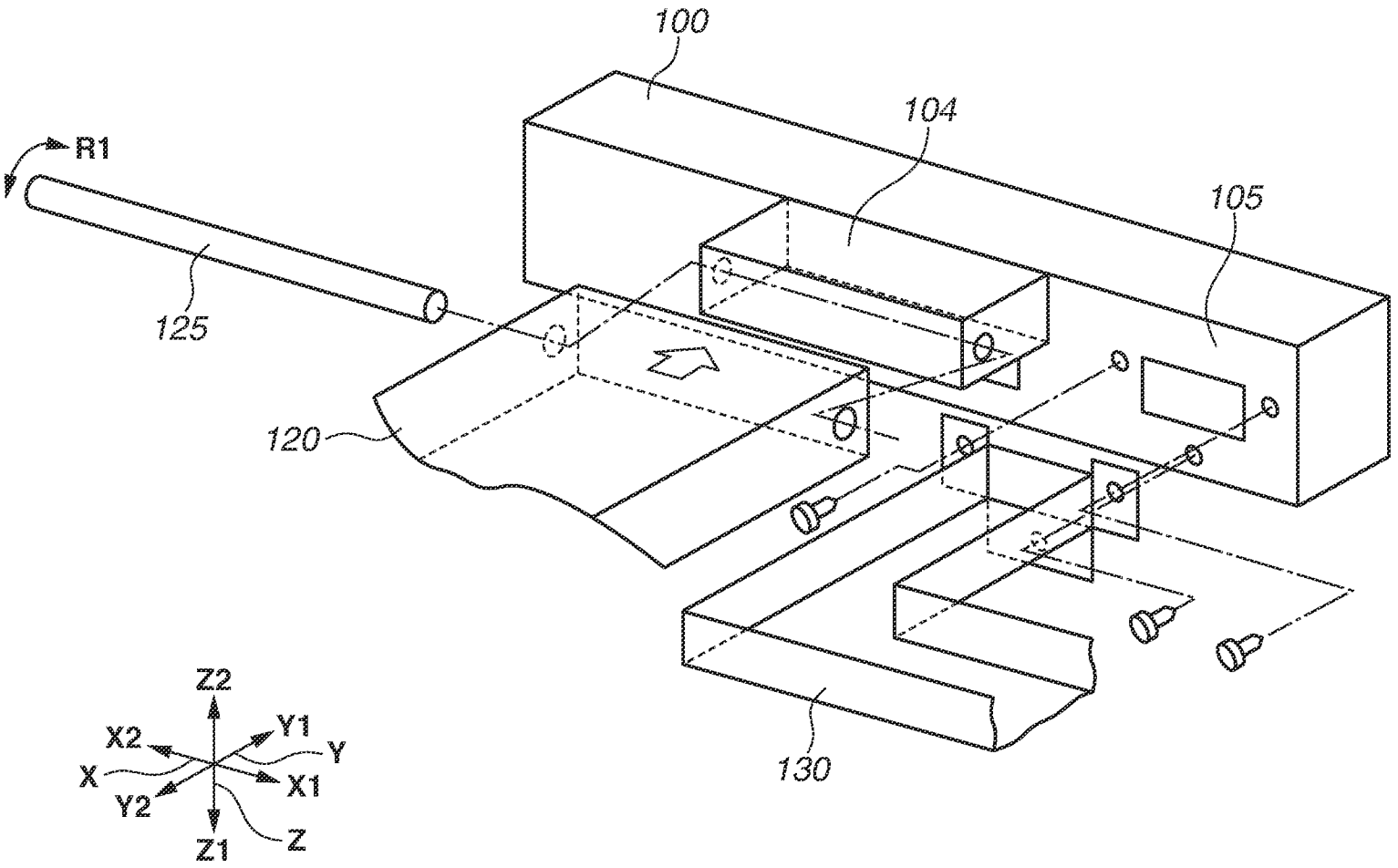
FIG. 7 is a perspective diagram illustrating a connection state of a turning arm and a relay member.

The connection portion 104 has openings for a rotation shaft portion 125 (illustrated in FIG. 7). The openings give passage to the rotation shaft portion 125 so that the turning arm 120 is held rotatably. The connection portion 105 has an opening portion 106 through which a cable described below passes. The connection portion 105 further has opening portions 107, 108, and 109 for connection to the relay member 130. The relay member 130 is attached to the first fixing member 100 by screw-fastening the opening portions 107, 108, and 109. The first fixing member 100 has a cavity in the inside, and the base cover 110 can cover the cavity from the Y1-direction side.

Next, a state of connection between the first fixing member 100 and each of the turning arm 120 and the relay member 130 will be described with reference to FIG. 7. FIG. 7 is a perspective diagram illustrating a state of connection of each of the turning arm 120 and the relay member 130.

Openings that give passage to the rotation shaft portion 125 are provided at an end portion on the first fixing member 100 side (the Y1-direction side) of the turning arm 120. The turning arm 120 is held rotatably by the first fixing member 100 in the R1-direction, by passing the rotation shaft portion 125 through the openings of the connection portion 104 of the first fixing member 100 and the openings of the turning arm 120. The reading apparatus 3 (not illustrated in FIG. 7) is attached to an end portion of the turning arm 120 on the side (the Y2-direction side) opposite to the first fixing member 100 side. The reading apparatus 3 is movable between a reading position in which an original document can be read, and a retraction position in which the reading apparatus 3 is retracted upward from the recording apparatus 2 (in the Z2-direction), by the rotation of the turning arm 120. Since the reading apparatus 3 is rotatably fixed, the turning arm 120 has relatively high rigidity, and a lightweight material is suitable for an improvement in operability for the user. Therefore, the turning arm 120 has a U-shape that is open on the under surface side (the Z1-direction), so that a lightweight and rigid structure is achieved. A steel sheet or aluminum is used as the material of the turning arm 120.

The relay member 130 has a U-shaped cross section that is open on the upper side (the Z2-direction). Specifically, the relay member 130 includes side surface members facing each other on the top surface of the housing unit 41, and a bottom surface member connecting these two side surface members. Further, the relay member 130 has a substantially L-shape when viewed from the Z2-direction. At one end portion of the relay member 130, an opening portion for connection to the first fixing member 100 is provided. The relay member 130 is fixed to the connection portion 105 of the first fixing member 100 at one end, and includes a short side part extending in the Y2-direction from the connection portion 105. The relay member 130 further includes a long side part extending in a direction (the X1-direction in the recording apparatus 2) intersecting with the short side part.

Figure 8:
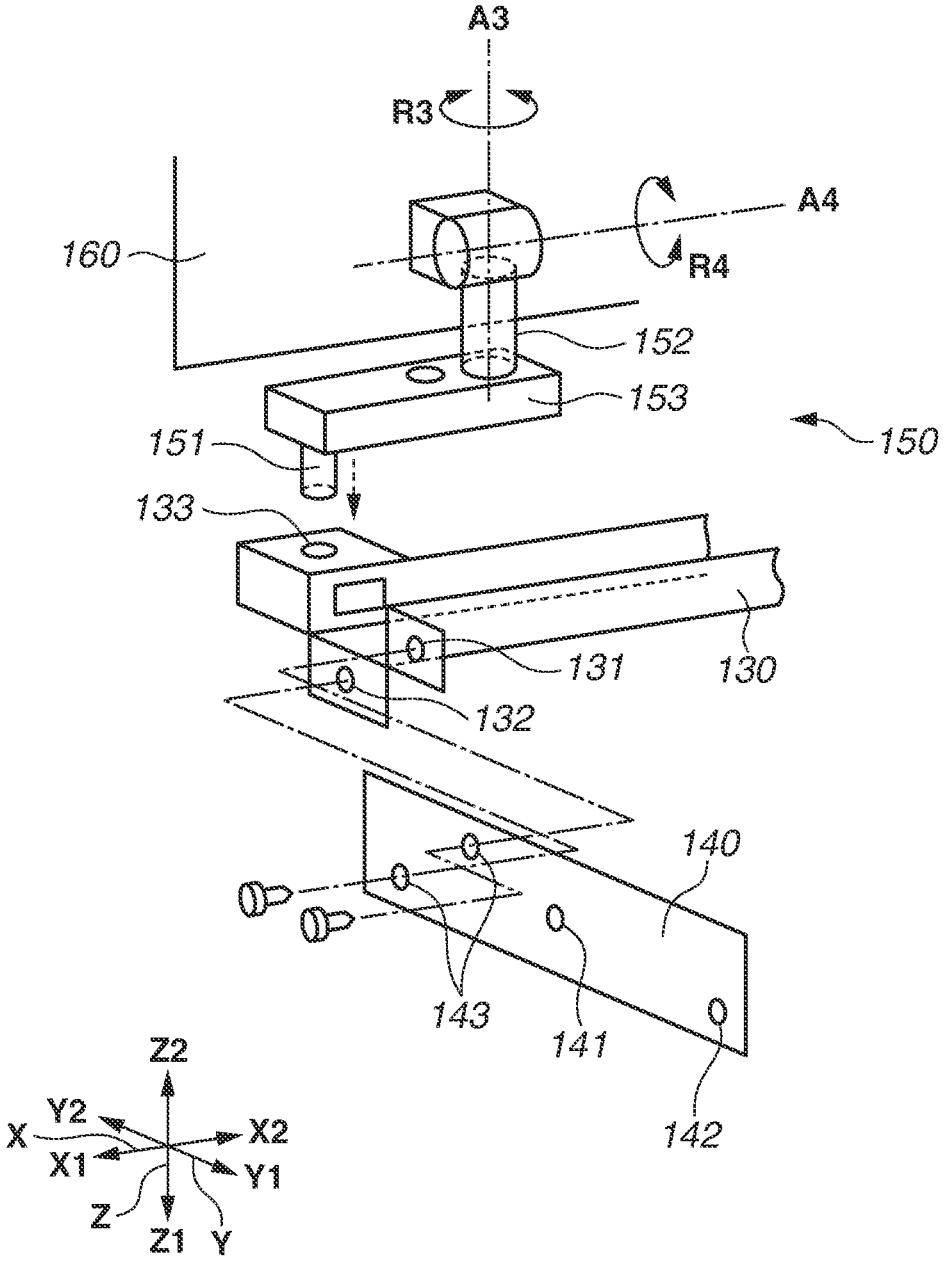
FIG. 8 is a perspective diagram illustrating a connection state of a holding member and a monitor arm.

Next, a state of connection between the relay member 130 and each of the side surface fixing member 140 and the monitor holding portion 150 will be described with reference to FIG. 8. FIG. 8 is a perspective diagram illustrating the state of connection between the relay member 130 and each of the side surface fixing member 140 and the monitor holding portion 150.

At an end portion of the long side part of the relay member 130, opening portions 131 and 132 for connection to the side surface fixing member 140 are provided. Further, the relay member 130 has an opening portion 133 for connection to a rotation shaft portion 151 that is a turning center of the monitor holding portion 150.

The side surface fixing member 140 extends in the depth direction (the Y1-direction) on the side surface of the housing unit 41 of the recording apparatus 2. The side surface fixing member 140 connects to the relay member 130 at a connection portion 143, and connects to the recording apparatus 2 at connection portions 141 and 142, to perform fixing. In other words, the side surface fixing member 140 is connected to the first fixing member 100 through the relay member 130 on the top surface of the housing unit 41. Specifically, the side surface fixing member 140 (i.e., a part of the second fixing member 180) connects to a plurality of parts along the depth direction on the side surface of the housing unit 41 of the recording apparatus 2. Since the side surface fixing member 140 connects to the recording apparatus 2 using the plurality of connection portions (141 and 142), the side surface fixing member 140 can be stably fixed to the recording apparatus 2. In particular, since the side surface fixing member 140 is fixed at the plurality of parts along the depth direction on the side surface of the housing unit 41, the side surface fixing member 140 can be fixed to prevent imposing an excessive load on the recording apparatus 2, in a case where the user moves the reading apparatus 3 back and forth in the depth direction or rotates the reading apparatus 3 around the axis A1. The side surface fixing member 140 is fixed at the side surface of the recording apparatus 2, but may also be fixed at a top surface part near the right end portion of the housing unit 41. Since both of the end portion of the top surface of the housing unit 41 and the side surface of the housing unit 41 are thus fixed, the end portion of the recording apparatus 2 is fixed while being pinched therebetween. Therefore, the recording apparatus 2 can also be stably held against vibration or the like of the reading apparatus 3.

The monitor holding portion 150 includes the rotation shaft portion 151, a monitor connection portion 152, and an arm portion 153. The rotation shaft portion 151 connects to the relay member 130 and the arm portion 153. The arm portion 153 is a member having a substantially cuboid shape extending in the X-direction. The monitor connection portion 152 connects to the display operating unit 160 and the arm portion 153. The monitor connection portion 152 is rotatable in the R3-direction and the R4-direction around the rotation axis A3 and the rotation axis A4, respectively.

Figure 9:
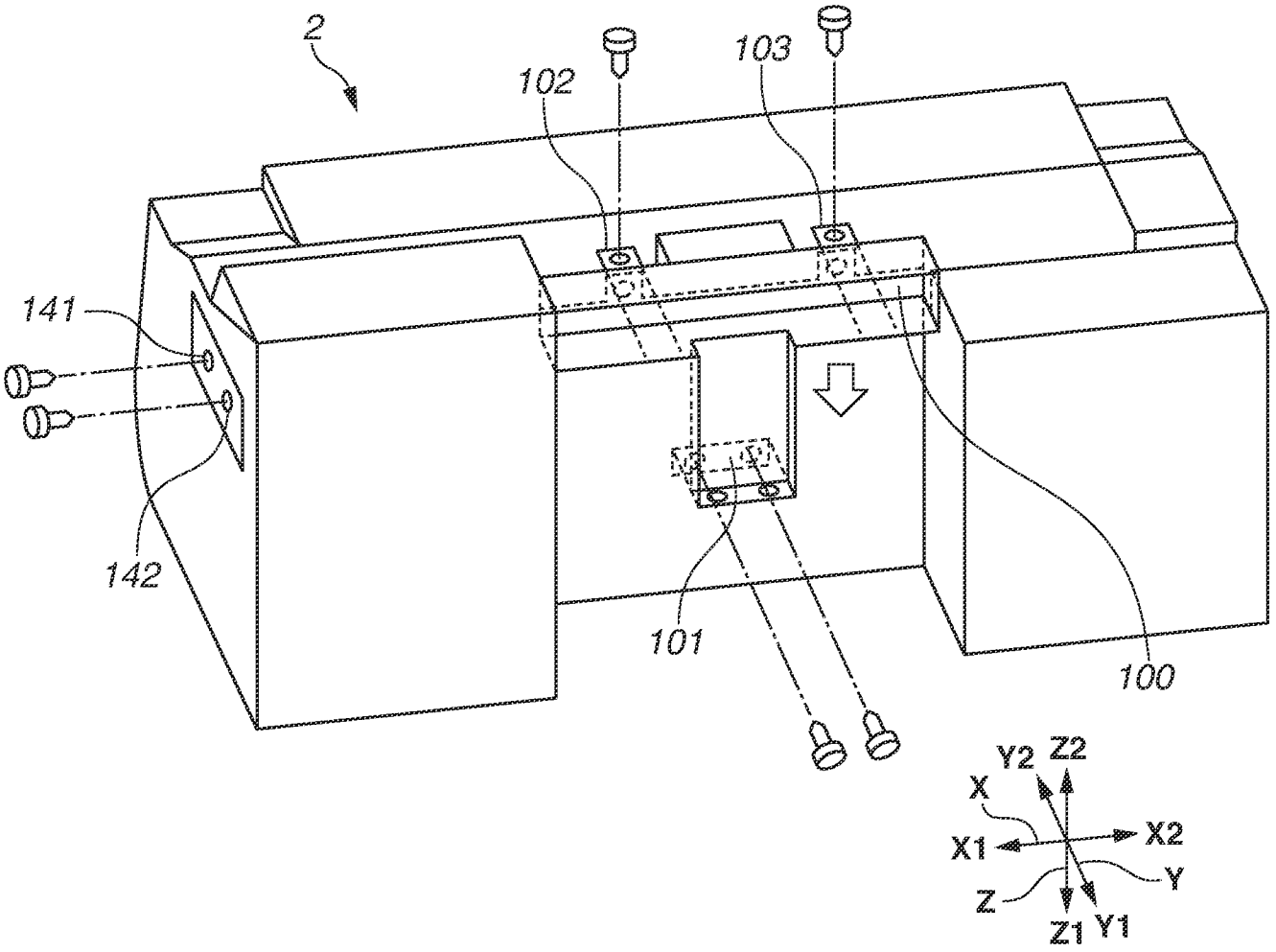
FIG. 9 is a perspective diagram illustrating a state of the holding unit connected to the recording apparatus.

Next, a connected state of the holding unit 99 to the recording apparatus 2 will be described with reference to FIG. 9. FIG. 9 is a perspective diagram illustrating the recording apparatus 2 as viewed from the back surface. In FIG. 9, only the first fixing member 100 and the side surface fixing member 140 of the holding unit 99 are illustrated, and other components are omitted.

The holding unit 99 is fixed to the recording apparatus 2 using the first fixing member 100 and the side surface fixing member 140. The first fixing member 100 has the connection portions 101, 102, and 103 for connection to the recording apparatus 2, as described with reference to FIGS. 6A and 6B. The side surface fixing member 140 further has the connection portions 141 and 142 for connection to the recording apparatus 2. The connection portion 101 of the first fixing member 100 is screw-fastened to the housing unit 41 of the recording apparatus 2, at two points substantially in the center of the back surface of the housing unit 41. The connection portions 102 and 103 of the first fixing member 100 are screw-fastened to the housing unit 41 of the recording apparatus 2, at two points in a rear portion on the top surface of the housing unit 41. The connection portions 141 and 142 of the side surface fixing member 140 are screw-fastened to the housing unit 41 of the recording apparatus 2, at two points, one is fastened near an upper central part and the other is fastened near an upper rear part, of the right side surface of the housing unit 41. Here, a configuration on the recording apparatus 2 side at the position where each of the connection portions is connected will be described. The recording apparatus 2 to which each of the connection portions is connected is configured to be a recess part present in the housing unit 41. The first fixing member 100 and the housing unit 41, as well as the side surface fixing member 140 and the housing unit 41, are co-fastened. The recess part is, for example, a hole or hollow formed through carrying out the processing for assembling the housing unit 41. This makes it possible to fix the holding unit 99 and the recording apparatus 2, without adding a new process to the recording apparatus 2 side. Further, the connection portion 101 is screw-fastened to the substrate holding member 95 on the recording apparatus 2 side. Furthermore, the connection portions 102 and 103 are screw-fastened to the fixing metal sheet 91. The connection portion 141 is also screw-fastened to the fixing metal sheet 91. In the present example embodiment, the number of the points for fixing to the recording apparatus 2 of the holding unit 99 is two, but the number may be one, or may be more than two. Each of the connection portions is fixed to the member having relatively high rigidity at the exterior of the recording apparatus 2, and therefore, the reading apparatus 3 can be stably supported. For the first fixing member 100, the method for connecting each member is not limited to the screw-fastening, and may be other method such as hooking.

Figure 10B:
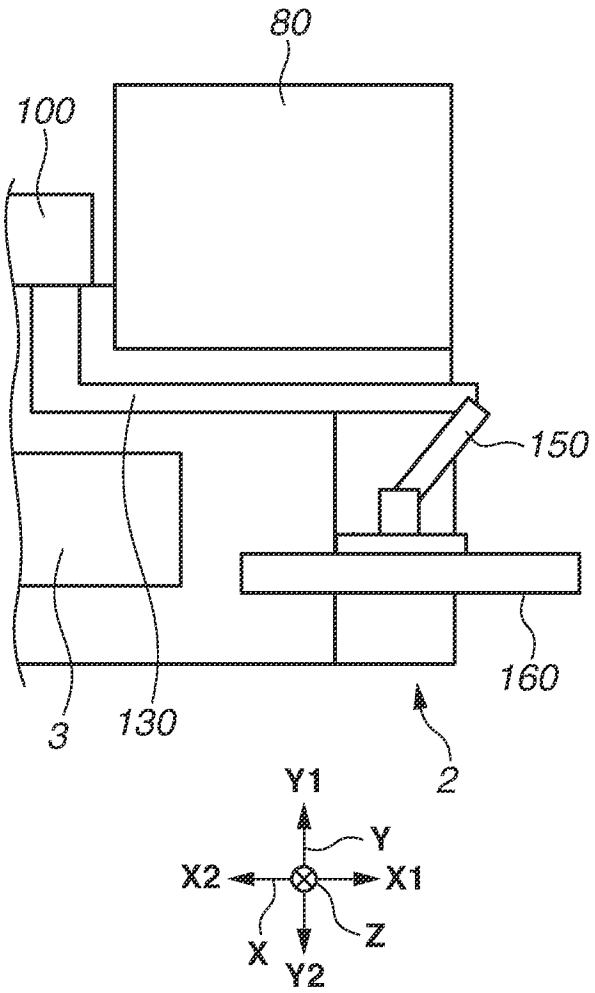
FIGS. 10A and 10B each illustrate a top view of an example layout of a display operating unit.
Figure 10A:
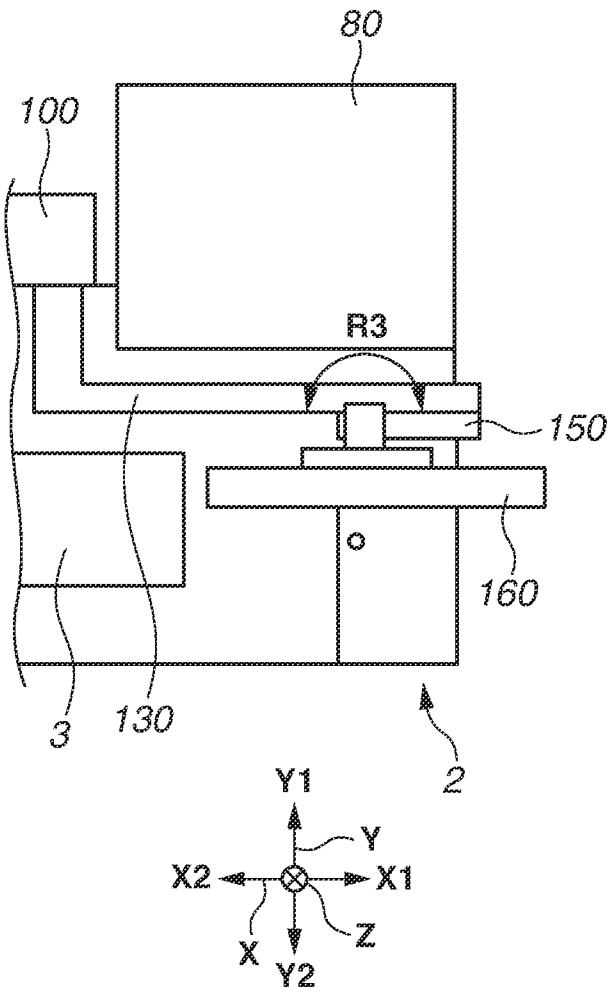

Next, a layout of the display operating unit 160 will be described with reference to FIGS. 10A, 10B, 11A, and 11B. FIGS. 10A and 10B each illustrate a top view of a part near the display operating unit 160 in the printing system 1, and illustrate a relevant position when the user operates the display operating unit 160. FIG. 10A is a diagram illustrating a reference position of the display operating unit 160. FIG. 10B is a diagram illustrating a position after the display operating unit 160 is moved in the Y2-direction from the position in FIG. 10A. FIGS. 10A and 10B each illustrate the printing system 1 as viewed from the top surface.

The display operating unit 160 is attached to the monitor holding portion 150 by the monitor connection portion 152. The monitor connection portion 152 is held to rotate in the R3-direction, as described above. Further, the monitor holding portion 150 is held rotatably by the relay member 130. Therefore, the user can move and operate the display operating unit 160 at a position and an angle that enable easy operation from the front surface of the recording apparatus 2, and can operate the moved display operating unit 160. Meanwhile, in the layout of the display operating unit 160 illustrated in FIGS. 10A and 10B, it is difficult to access the ink tank cover 80 from the discharge port 70 side, i.e., from the front surface of the recording apparatus 2.

Figure 11B:
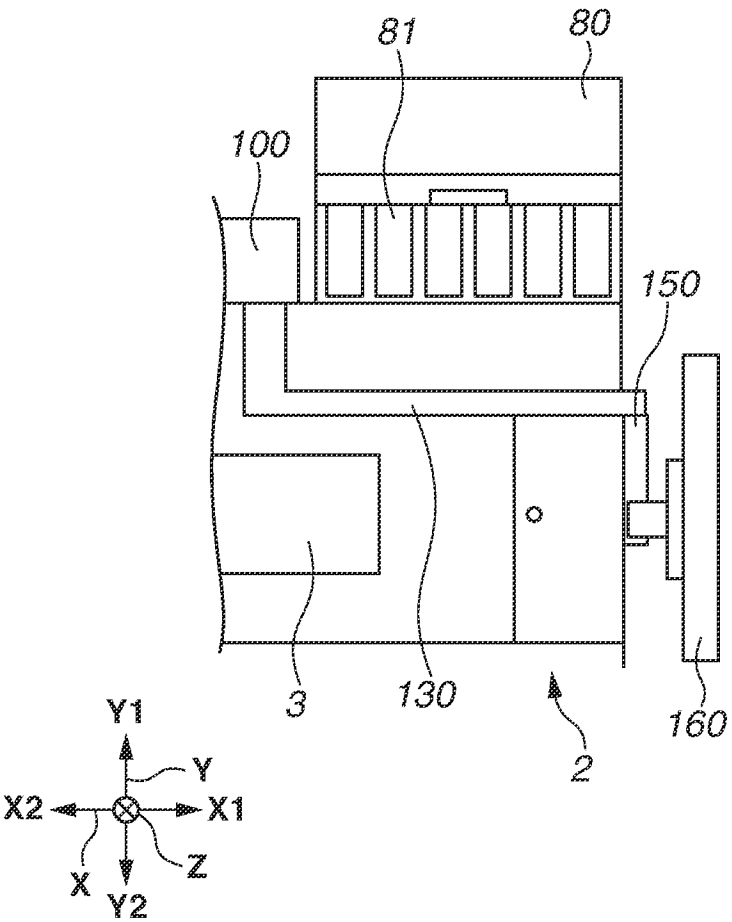
FIG. 11B is a diagram illustrating a top view of the layout in the same state.
Figure 11A:
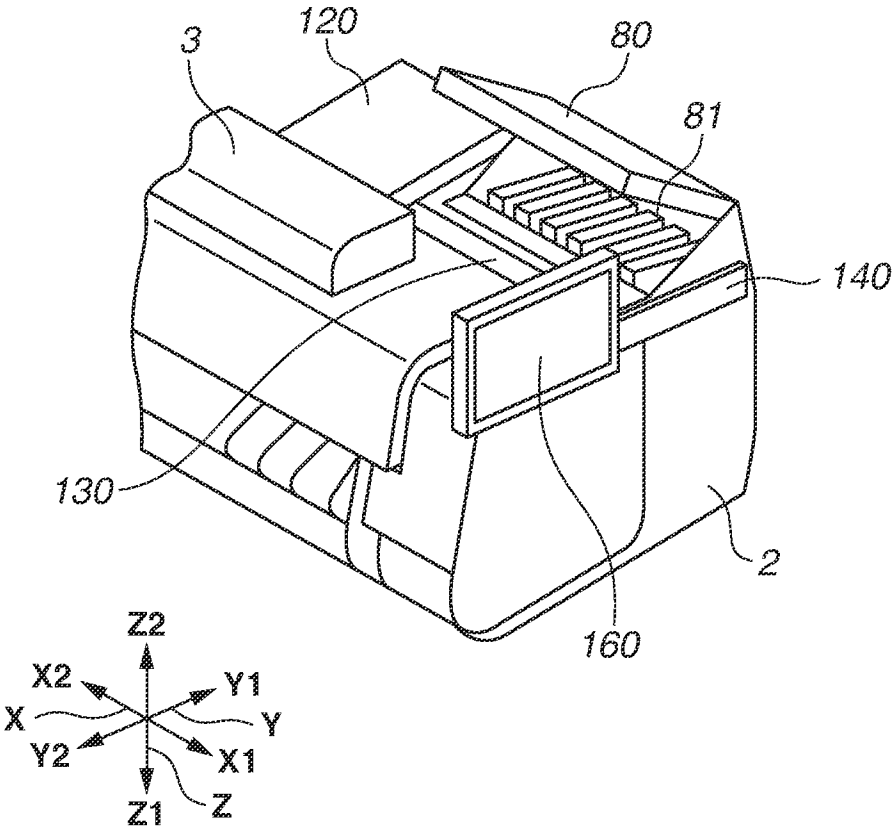
FIG. 11A is a perspective diagram illustrating a layout of the display operating unit in a state where a cover is open.

Next, a suitable layout of the display operating unit 160 for replacement of the ink tank will be described with reference to FIGS. 11A and 11B. FIG. 11A is a perspective diagram illustrating a part near the display operating unit 160 in a state where the ink tank cover 80 is open. FIG. 11B is a diagram illustrating a top view of the part near the display operating unit 160 in the state where the ink tank cover 80 is open. In FIGS. 11A and 11B, the recording apparatus 2 is in a state where the ink tank cover 80 is open and the ink tank 81 is accessible. As illustrated in FIG. 11B, the rotation shaft portion 151 (see FIG. 8) of the monitor holding portion 150 can be rotated so that the monitor holding portion 150 is positioned more outward (on the X1-direction side) than the front surface of the ink tank cover 80. Therefore, the user can access the ink tank 81 from the front surface of the recording apparatus 2, by moving the display operating unit 160.

As described above, the display operating unit 160 is movable, and therefore, the relay member 130, the side surface fixing member 140, and the monitor holding portion 150 come to receive force in the movement. Meanwhile, the side surface fixing member 140 extends to the rear part of the recording apparatus 2 (in the Y1-direction) and is fixed. Accordingly, the distance from each of the rotation axes A2 and A3 of the monitor holding portion 150 to the connection portion 142 can be increased, so that the force applied to one point of the recording apparatus 2 can be suppressed.

Figure 12:
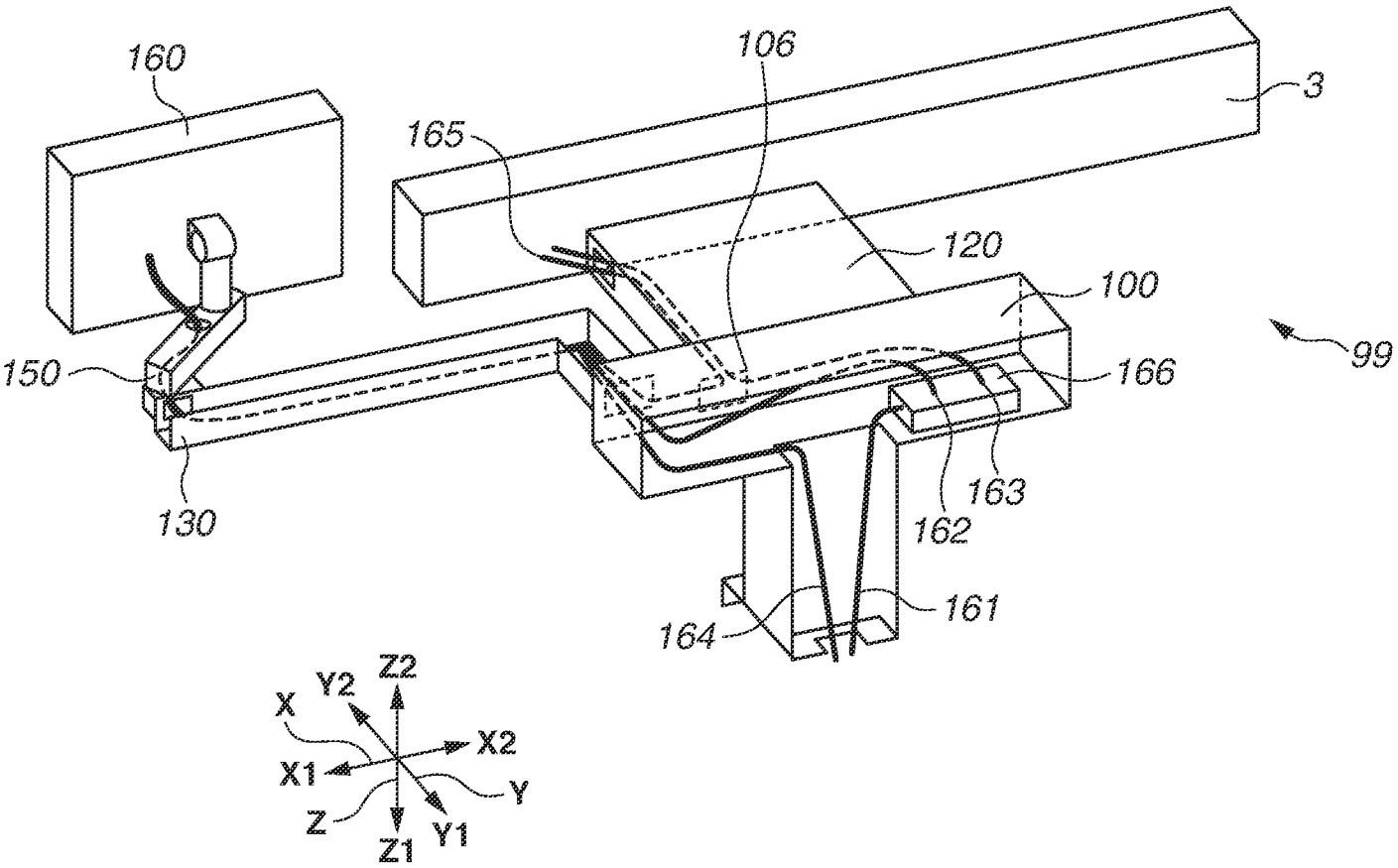
FIG. 12 is a perspective diagram illustrating an electric-cable wiring state in the holding unit.

Next, cable wiring for connecting the reading apparatus 3 and the display operating unit 160 will be described with reference to FIG. 12. FIG. 12 is a diagram illustrating the holding unit 99 as viewed from the back surface, and is also a perspective diagram illustrating a wiring state of electric cables in the holding unit 99. The electric cables include a cable that electrically connects each apparatus.

A power cable 163 and a signal cable 165 are connected to the reading apparatus 3. The power cable 163 connects an external power source with the reading apparatus 3 via a wiring relay unit 166 installed inside the first fixing member 100. Power is supplied from the external power source to the reading apparatus 3 through the wiring. The signal cable 165 connects the reading apparatus 3 with the display operating unit 160. The signal cable 165 transfers, for example, various setting operations and input signals of commands related to the reading apparatus 3 that are input from the display operating unit 160, and data signals read by the reading apparatus 3.

Next, a wiring path of each electric cable will be described. The power cable 163 and the signal cable 165 run through the inside of the turning arm 120 from an opening of a side surface of the turning arm 120 and reaches the first fixing member 100. The power cable 163 and the signal cable 165 enter the first fixing member 100 through the opening portion 106 of the first fixing member 100. The power cable 163 is then connected to the wiring relay unit 166. On the other hand, the signal cable 165 passing through the opening portion 106 of the first fixing member 100 reaches the relay member 130. The signal cable 165 is wired inside the portion having the U-shaped cross section of the relay member 130, and connected to the display operating unit 160 through the arm portion 153.

A power cable 162 and a signal cable 164 are connected to the display operating unit 160. The power cable 162 is connected to the wiring relay unit 166. The signal cable 164 connects the recording apparatus 2 with the display operating unit 160, and transmits signals of various setting operations and commands that are input from the display operating unit 160, and data signals transmitted from the reading apparatus 3 to the display operating unit 160, to the recording apparatus 2.

The power cable 162 and the signal cable 164 reach the relay member 130 via the inside of each of the monitor holding portion 150 and the arm portion 153. The relay member 130 has the U-shaped cross section, and therefore, the power cable 162 and the signal cable 164 are wired inside thereof, and enter the first fixing member 100 from the opening portion 106 of the connection portion 105 of the first fixing member 100. The power cable 162 is connected to the wiring relay unit 166.

The power cables 162 and 164 can each be further connected to an alternating current (AC) adapter in serial, so that the AC adapter can also be connected to the wiring relay unit 166 of the first fixing member 100. The signal cable 164 of the display operating unit 160 and a relay cable 161 extending from the wiring relay unit 166 to the outside are connected to the recording apparatus 2 and a power source such as the external power source, respectively. As described above, various cables can be wired and a component such as the wiring relay unit 166 can be arranged using the inner space of the holding unit 99.

As described above, the printing system 1 according to the present example embodiment includes the holding unit 99 that is connected to the housing unit 41 of the recording apparatus 2 at least at the one end, and holds the reading apparatus 3 above the housing unit 41. Further, the holding unit 66 includes the first fixing member 100 for fixing at the back surface portion of the housing unit 41, and the second fixing member 180 for fixing at the side surface portion of the housing unit 41. Therefore, the reading apparatus 3 can be stably held relative to the recording apparatus 2. In a case where the recording apparatus 2 and the reading apparatus 3 are selectively used for the printing system 1, it is possible to achieve stable holding while ensuring the convenience of the user because a member for fixing on the discharge port 70 side is not present.

Second Example Embodiment

Figure 13:
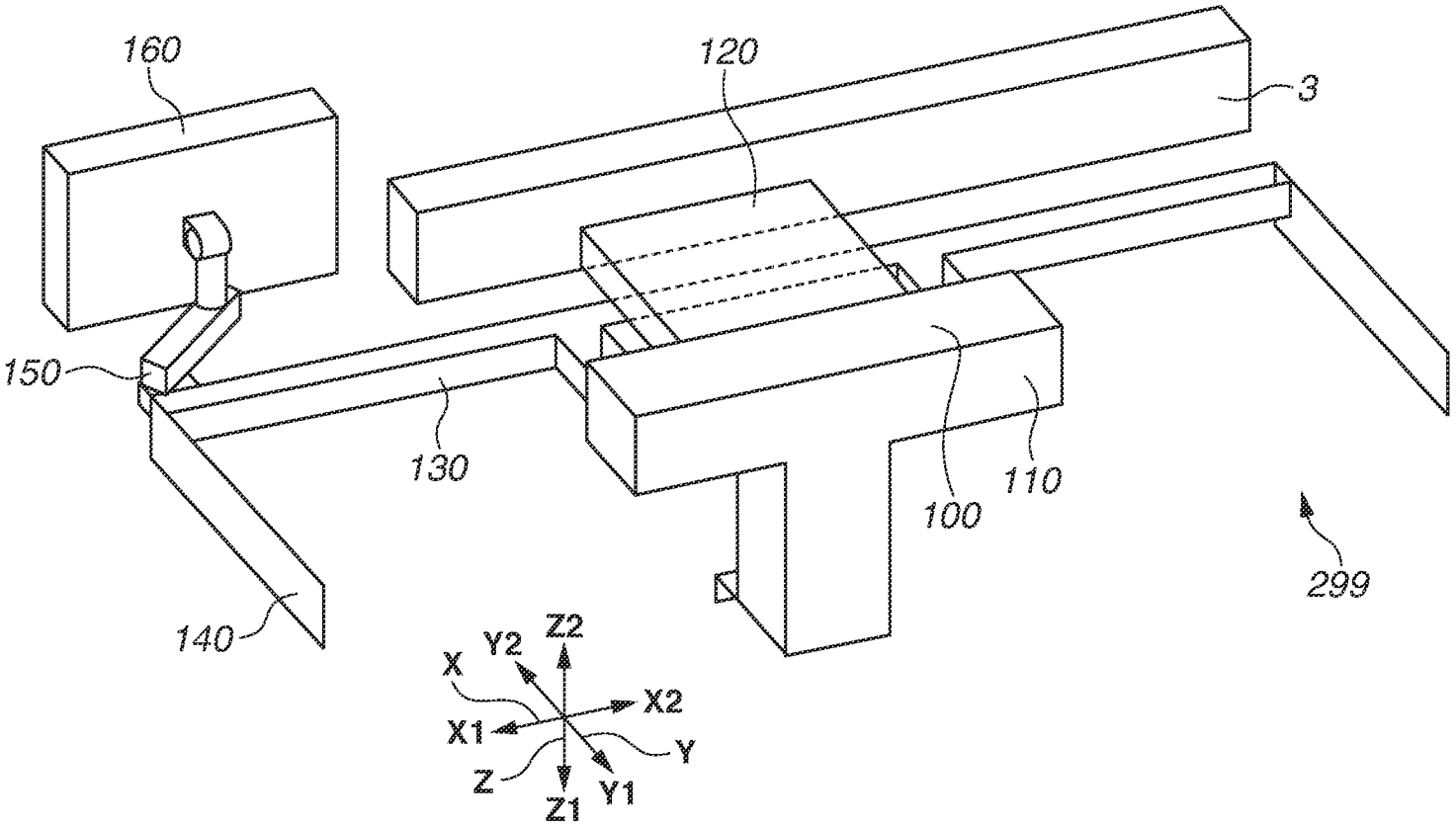
FIG. 13 is a perspective diagram illustrating a holding unit according to a second example embodiment.

Next, a second example embodiment will be described with reference to FIG. 13. FIG. 13 is a perspective diagram illustrating a holding unit 299 in the second example embodiment. The second example embodiment is different from the first example embodiment in that a relay member 130 extends toward both side surfaces of a housing unit 41 on the top surface of the housing unit 41, and fixing on both side surfaces of the housing unit 41 is achieved by a side surface fixing member 140. In the first example embodiment, the relay member 130 extends to the right side surface of the recording apparatus 2, and the fixing is achieved only on the right side surface by the side surface fixing member 140. With this configuration of the second example embodiment, strength of the holding unit 299 can be improved, as compared with the first example embodiment.

Third Example Embodiment

Figure 14:
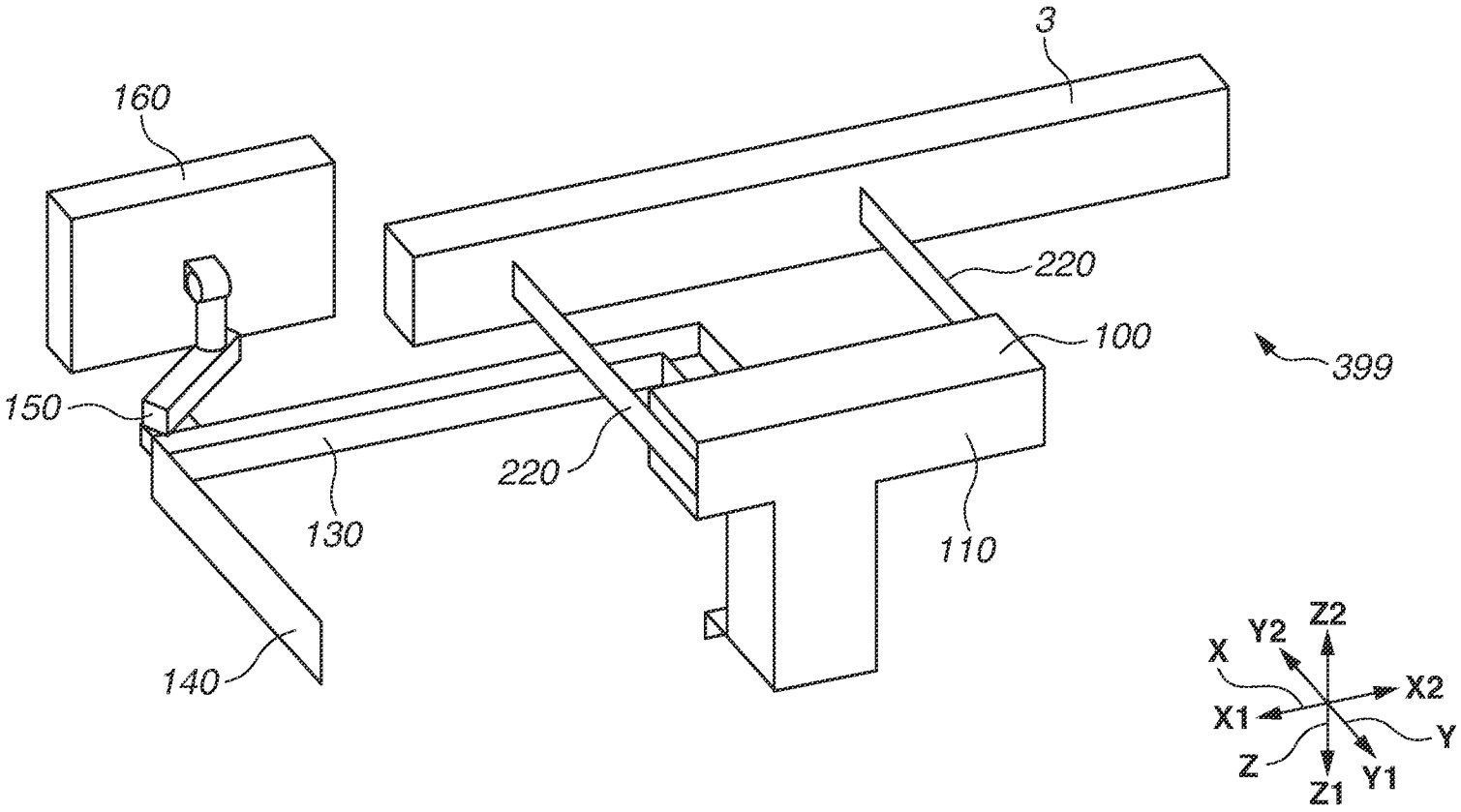
FIG. 14 is a perspective diagram illustrating a holding unit according to a third example embodiment.
Figure 15:
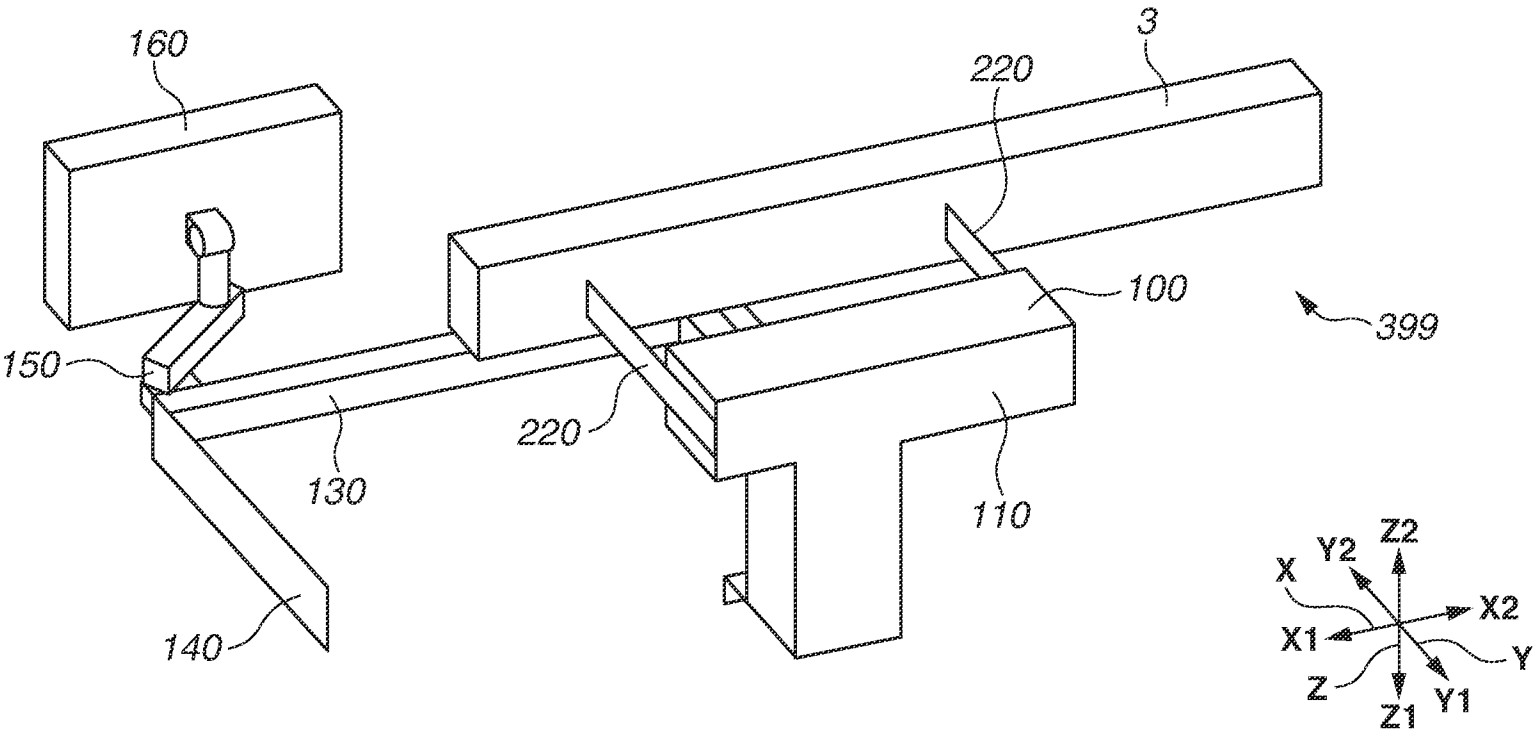
FIG. 15 is a perspective diagram illustrating the holding unit according to the third example embodiment.

Next, a third example embodiment will be described with reference to FIG. 14 and FIG. 15. FIG. 14 and FIG. 15 are perspective diagrams each illustrating a holding unit 399 in the third example embodiment. The third example embodiment is different from other example embodiments in terms of a driving mechanism of a reading apparatus 3. A part similar or corresponding to a part of the first example embodiment is provided with the same reference numeral as the first example embodiment, and will not be described.

FIG. 14 is a schematic perspective diagram illustrating the reading apparatus 3, a display operating unit 160, and the holding unit 399 (a recording apparatus 2 not illustrated) as viewed from the rear. In the holding unit 399, a pair of guide portions 220 are attached to a first fixing member 100, and the reading apparatus 3 is fixed to the tip of each of the guide portions 220.

The guide portions 220 are fixed to both side surfaces of the first fixing member 100, and disposed above a relay member 130 (i.e., at an upper position in the Z2-direction). The guide portions 220 are configured of, for example, a multistage guide member such as a slide rail. Each of the guide portions 220 is a component that extends and contracts in a front-back direction (the Y-direction) of a printing system 1. Therefore, the holding unit 399 enables a user to move the reading apparatus 3 back and forth relative to the recording apparatus 2. The reading apparatus 3 can be disposed frontward (in the Y2-direction) by the guide portions 220 to a reading position as illustrated in FIG. 14. The reading apparatus 3 can also be moved backward (in the Y1-direction) to a retraction position as illustrated in FIG. 15, in a case where the recording apparatus 2 is used.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2019-068042, filed Mar. 29, 2019, which is hereby incorporated by reference herein in its entirety.

What is claimed is:

1. A printing system comprising:

a printing unit configured to perform printing on a recording medium;

a housing including a front surface portion, a back surface portion, a top surface portion, and a side surface portion, wherein the front surface portion has a discharge port for discharging the recording medium on which printing is performed, the back surface portion faces the front surface portion, the top surface portion connects the front surface portion with the back surface portion at an upper side of the printing unit, and the side surface portion connects the front surface portion with the back surface portion in a width direction of the discharge port;

a turning arm configured to rotate a reading unit away from the top surface portion, wherein the reading unit is configured to read an image of an original document;

a first fixing member configured to hold the turning arm rotatably relative to the top surface portion and fixed to the back surface portion;

a second fixing member fixed to the side surface portion; and a connecting member configured to connect the first fixing member and the second fixing member at a predetermined position above the top surface portion.

2. The printing system according to claim 1, wherein the second fixing member extends in a depth direction in the side surface portion, and is fixed to a plurality of parts arranged along the depth direction.

3. The printing system according to claim 1, wherein the second fixing member is fixed by being co-fastened with the side surface portion.

4. The printing system according to claim 1, wherein the second fixing member is fixed to the housing at an end portion of the top surface portion of the housing.

5. The printing system according to claim 4, wherein the connecting member includes two side surface members facing each other on the top surface portion of the housing, and a bottom surface member connecting the two side surface members.

6. The printing system according to claim 1, further comprising:

an operation unit configured to receive an input instruction for the reading unit and held on the connecting member; and a cable configured to electrically connect the operation unit with the reading unit, wherein the cable is wired through the connecting member.

7. The printing system according to claim 6, wherein the operation unit is held rotatably relative to the connecting member, between a first position located more inward than the side surface portion, and a second position located more outward than the side surface portion.

8. The printing system according to claim 7, further comprising a tank for storing ink to be supplied to the printing unit, wherein the operation unit is positioned on a front surface side of the tank when the operation unit is in the first position, and is positioned away from the front surface side of the tank when the operation unit is in the second position.

9. The printing system according to claim 1, wherein a cable wired from the reading unit passes an inside of the turning arm and an inside of the first fixing member.

10. The printing system according to claim 1, wherein the connecting member does not rotate relative to the top surface portion.

11. The printing system according to claim 1, wherein the first fixing member is fixed to the top surface portion.

12. The printing system according to claim 1, wherein the connecting member is connected to the first fixing member on the side surface portion side relative to the turning arm.

13. A turning apparatus to be used for a printing system having a printing unit configured to perform printing on a recording medium, and having a housing including a front surface portion, a back surface portion, a top surface portion, and a side surface portion, wherein the front surface portion has a discharge port for discharging the recording medium on which printing is performed, the back surface portion faces the front surface portion, the top surface portion connects the front surface portion with the back surface portion at an upper side of the printing unit, and the side surface portion connects the front surface portion with the back surface portion in a width direction of the discharge port, the turning apparatus comprising:

a turning arm configured to rotate a reading unit away from the top surface portion, wherein the reading unit is configured to read an image of an original document;

a first fixing member configured to hold the turning arm rotatably relative to the top surface portion and fixed to the back surface portion;

a second fixing member fixed to the side surface portion; and a connecting member configured to connect the first fixing member and the second fixing member at a predetermined position above the top surface portion.

14. The turning apparatus according to claim 13, wherein the second fixing member extends in a depth direction in the side surface portion, and is fixed to a plurality of parts arranged along the depth direction.

15. The turning apparatus according to claim 13, wherein the second fixing member is fixed by being co-fastened with the side surface portion.

16. The turning apparatus according to claim 13, wherein the second fixing member is fixed to the housing at an end portion of the top surface portion of the housing.

17. The turning apparatus according to claim 16, wherein the connecting member includes two side surface members facing each other on the top surface portion of the housing, and a bottom surface member connecting the two side surface members.

18. The turning apparatus according to claim 13, further comprising:

an operation unit configured to receive an input instruction for the reading unit and held on the connecting member; and a cable configured to electrically connect the operation unit with the reading unit, wherein the cable is wired through the connecting member.

19. The turning apparatus according to claim 18, wherein the operation unit is held rotatably relative to the connecting member, between a first position located more inward than the side surface portion, and a second position located more outward than the side surface portion.

20. The turning apparatus according to claim 19, further comprising a tank for storing ink to be supplied to the printing unit, wherein the operation unit is positioned on a front surface side of the tank when the operation unit is in the first position, and is positioned away from the front surface side of the tank when the operation unit is in the second position.

21. The turning apparatus according to claim 13, wherein a cable wired from the reading unit passes an inside of the turning arm and an inside of the first fixing member.

22. The turning apparatus according to claim 13, wherein the connecting member does not rotate relative to the top surface portion.

23. The turning apparatus according to claim 13, wherein the first fixing member is fixed to the top surface portion.

24. The turning apparatus according to claim 13, wherein the connecting member is connected to the first fixing member on the side surface portion side relative to the turning arm.

* * * * *